United States Patent [19]

Robinson

[11] Patent Number: 4,691,115

[45] Date of Patent: Sep. 1, 1987

[54] SYSTEM FOR ROTATING A DRIVE MECHANISM FOR POWER GENERATION

[76] Inventor: Jerry W. Robinson, P.O. Box 1244, Weaverville, N.C. 28787

[21] Appl. No.: 824,713

[22] Filed: Jan. 31, 1986

[51] Int. Cl.[4] ..... F01D 15/10

[52] U.S. Cl. ..... 290/1 R; 290/54

[58] Field of Search ..... 290/1, 43, 53, 54; 185/27, 32; 415/DIG. 2

[56] References Cited

U.S. PATENT DOCUMENTS

| | | | |
|---|---|---|---|
| 931,402 | 8/1909 | Ferguson | 185/27 |
| 3,028,727 | 4/1962 | Anston | 185/27 X |
| 3,536,929 | 10/1970 | Parker | 290/1 X |

FOREIGN PATENT DOCUMENTS

| | | | |
|---|---|---|---|
| 2466 | of 1877 | United Kingdom | 415/DIG. 2 |
| 451 | of 1878 | United Kingdom | 415/DIG. 2 |

*Primary Examiner*—William M. Shoop, Jr.
*Assistant Examiner*—W. E. Duncanson, Jr.
*Attorney, Agent, or Firm*—Pitts and Brittian

[57] ABSTRACT

A system for rotating a drive mechanism which can be connected to an electrical generator or the like. The system (10) is particularly suitable for providing electrical power to a residence and includes a reservoir (14) for containing a volume of liquid such as water (16). Weight is applied to the upper surface of the liquid for forcing it downward. This liquid is discharged from the reservoir through a spout (36) which concentrates the discharged liquid into a stream which is directed against a drive mechanism (38) such as a turbine (40) for imparting rotational forces. The discharged water is received in a catch basin (50) from which it is then moved, as by pumping, back into the reservoir for a further cycle of operation.

13 Claims, 2 Drawing Figures

SYSTEM FOR ROTATING A DRIVE MECHANISM FOR POWER GENERATION

TECHNICAL FIELD

This invention relates generally to an apparatus for generating electrical power and is more particularly directed to a system for rotating a drive mechanism such as a turbine which can be connected to an electrical generator. The device has particular application for use in connection with generating electricity for residential use and utilizes a system of weights to increase the power generated.

BACKGROUND ART

Various types of hydro-electrical generators have heretofor been known in the art. Such devices generally include means for holding water which is used to drive a turbine for generating electricity. Known prior art devices are disclosed in the following U.S. Pat. Nos. 4,284,899; 4,408,127; and 4,443,707.

The present system is designed to provide a simple mechanical system for effectively generating electricity for residential use. The system can be readily manufactured and easily maintained. Further, the system is designed such that the force under which the fluid medium, such as water, is discharged from the reservoir can be varied in order to vary the energy which can be converted into electrical power. In this connection, means are provided for selectively varying the downward pressure applied to liquid contained in the reservoir such that the force of water exiting said reservoir through a spout can be adjusted.

BRIEF DESCRIPTION OF THE DRAWINGS

The above-mentioned features and objects of the present invention will be more clearly understood upon reading the detailed description of the invention together with the accompanying drawings, in which.

DISCLOSURE OF THE INVENTION

A system for rotating a drive mechanism such as a turbine which can be connected to an electrical generator or the like is provided. The system includes a reservoir containing a volume of liquid such as water. Weight is applied to the upper surface of the liquid contained in the reservoir to enhance the force under which this liquid exits a spout. The spout is designed to discharge water from the reservoir in a concentrated stream which is directed against the drive mechanism for imparting rotational forces thereto. The spent water is collected in a catch basin positioned below the reservoir. This water is pumped, or moved, from the catch basin back into the reservoir for completion of a subsequent cycle of operation. In an alternate embodiment, a plurality of reservoirs are provided for continuous operation of the system for purposes of generating electrical power for residential use.

BEST MODE FOR CARRYING OUT THE INVENTION

Figure 1:
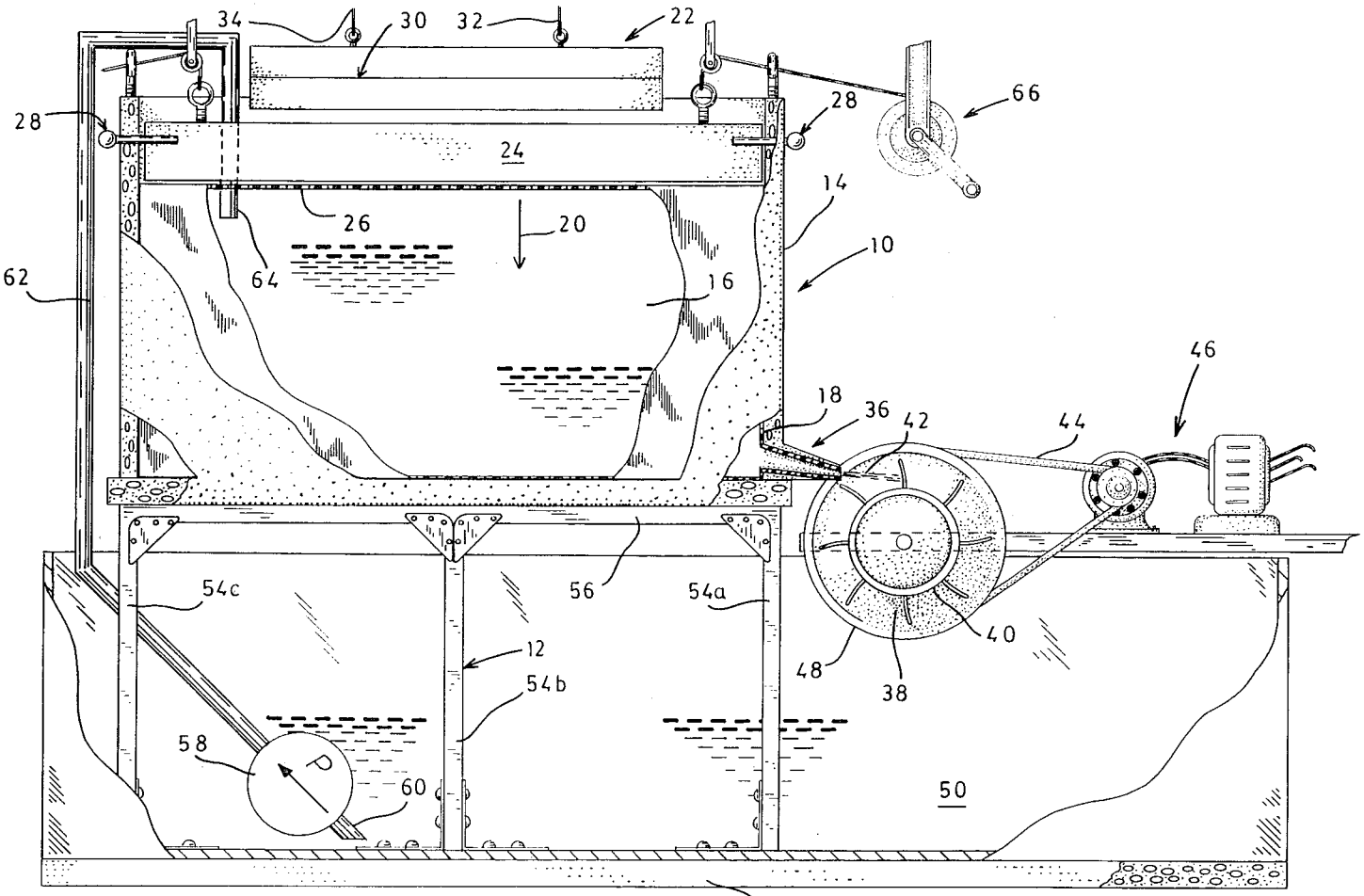
FIG. 1 is a side elevation view of a system incorporating various features of the present invention. Portions of the figure are shown in sectional views to more clearly delineate details of the system structure.

Referring now to the drawings, an improved system for generating electrical power for residential use is generally indicated at 10 in FIG. 1. This system 10 includes a frame indicated at 12 which supports the various system components. More specifically, the frame 12 in the embodiment depicted in FIG. 1 supports a reservoir 14 which contains a volume of liquid such as water 16. The walls of the reservoir 14 are preferably fabricated from a heavy duty plastic material, and can be provided with a suitable liner 18 as is necessary or desired. Of course, it will be recognized that other materials can be provided to contain the water 16.

A downward pressure is applied to liquid contained in the reservoir 14. This downward pressure is applied in the direction of the arrow 20 depicted in FIG. 1. In this connection, weight means generally indicated at 22 is provided. The weight means 22 in the illustrated embodiment includes a top cover 24 which is positioned above the upper surface 26 of the water 16. This cover 24 is substantially identical in cross-sectional outline with the reservoir 14, and dimensioned such that it will readily move within the reservoir in the direction of the arrow 20.

Locking means generally indicated at 28 serve to position the cover 24 proximate the upper portion of the reservoir as illustrated in FIG. 1. More specifically, the locking means 28 comprises a pair of elongated pins which extend through the wall of the reservoir 14, and into the cover 24 such that the vertical position of the cover 24 can be fixed as desired. For example, when the reservoir 14 is being filled, it is preferable to secure the top cover 24 at the location illustrated such that the weight of this cover will not interfer with the filling operation which will be described in greater detail hereinafter.

As necessary or desired, this top cover 24 can run in tracks (not shown) mounted on the internal surface of the reservoir 14 to facilitate movement of the top cover 24 in the direction of the arrow 20.

The weight means 22 also includes a series of weights generally indicated at 30. These weights 30 can be selectively positioned on the upper surface of the top cover 24 to increase the pressure applied to the liquid contained in the reservoir in the direction of the arrow 20. These weights serve to maintain a constant flow of water from the reservoir and can be varied as necessary, or desired, to increase the pressure of the water exiting such reservoir. In the embodiment depicted in FIG. 1, the weights can be lifted away from the top cover 24 by applying an upward vertical force to the weights through the cables 32 and 34 illustrated These cables can be connected to a manually or automatically operated winch or pair of winches (not shown) for purposes of removing or lifting them from the cover 24.

A spout generally indicated at 36 is provided for discharging water from the reservoir in a stream which is directed against a drive mechanism 38 incorporating the illustrated turbine 40. This spout 36 is preferably tapered to increase the pressure at the discharge location of the spout. In the embodiment depicted in FIG. 1, the spout is mounted proximate the lower portion of the reservoir at a location such that the stream of water 42 engages the turbine blades for imparting rotational forces to the drive mechanism 38. As shown in FIG. 1, this drive mechanism is connected through a suitable belt 44 to an electrical generator system 46 which is of conventional design. In the preferred embodiment, the turbine 40 is mounted on a suitable flywheel 48 which assists in increasing the constant rotational speed of the turbine 40. The application of pressure to the upper surface of the water through the weight means 22 which incorporates a series of weights 30 increases the pressure of the water exiting the reservoir through the spout 36. In one embodiment, the spout can be selectively opened and closed by conventional valve means.

After the water has been discharged against the blades of the turbine 40 and imparted rotational forces to the drive mechanism 38, it falls under the force of gravity into a catch basin 50 depicted in FIG. 1. The illustrated catch basin comprises a suitable reservoir fabricated from a heavy duty plastic or other suitable water impervious material. In the depicted embodiment, the floor 52 of the catch basin 50 supports the depicted frame members 54A–C which carry at their upper end portions the platform 56 which supports the lower portion of the reservoir 14. Water received within the catch basin 50 is moved into or returned to the reservoir 14. In this connection, a suitable pump 58 is provided. This pump 58 serves to receive water through an intake conduit 60 to the reservoir 14 through the conduit section 62 which terminates at location 64 depicted in FIG. 1.

After the reservoir 14 has emptied and the water has been discharged through the tapered spout 36, under the additional pressure applied by the weight means 22, and the operatively associated series of weights 30, the weight means including the top cover 24 and the weights 30 are returned to a position proximate the upper portion of the tank as depicted in FIG. 1, such that the tank can be refilled by operation of the pump 58. In this connection, means for positioning the weight means is provided. Such means is generally indicated at 66 in FIG. 1. This means 66 serves to move or position the weight means at the location depicted in FIG. 1 such that the weight means can be locked into position for refilling the reservoir. In the illustrated embodiment, such means 66 comprises a winch or the like which can be manually driven or driven by the application of suitable power means. It is within the scope of the present invention to have such means 66 powered by an individual turning the illustrated crank arm for moving the top cover 24 and the operatively associated series of weights 30 to a position proximate the top of the reservoir for refilling the reservoir. Also, the means 66 can be driven as by an exercise machine such as a suitable stationary exercise bicycle.

Figure 2:
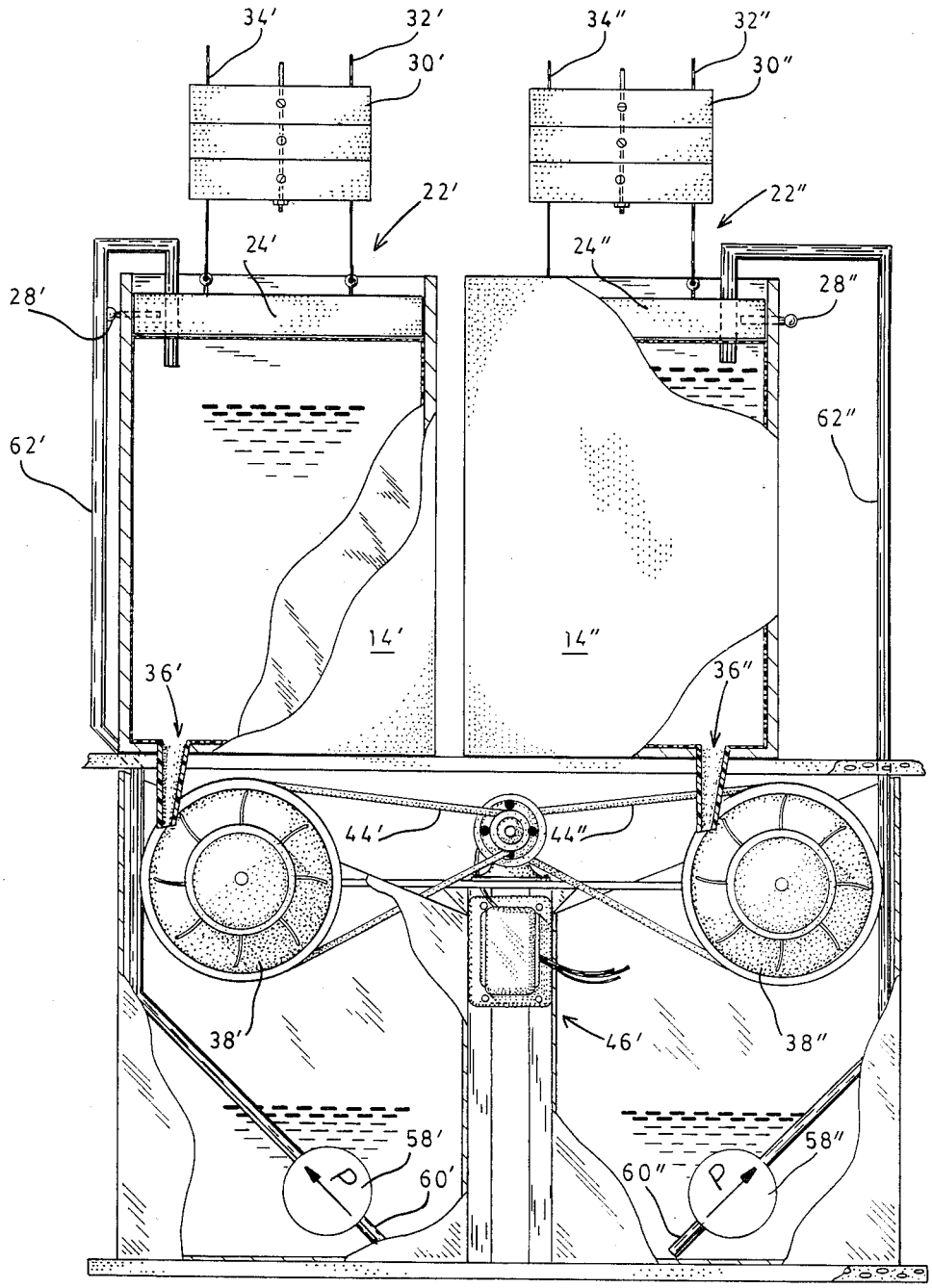
FIG. 2 represents a side elevation view of an alternate embodiment of a system constructed in accordance with the present invention. In this embodiment, sequential emptying of reservoirs is accomplished such that power can be generated on a continuous basis as is necessary or desired.

An alternate embodiment of the system of the present invention is illustrated in FIG. 2. In this embodiment, primed (') and double primed (") numerals are used to depict components similar in structure to components depicted in the single reservoir system shown in FIG. 1. The system depicted in FIG. 2 is designed for sequentially emptying and filling of the reservoirs 14' and 14" such that continuous power is generated by the electrical generator system 46'. In this regard, the reservoir 14' is first filled and the weight means 30 is applied such that pressure is applied to liquid contained in the reservoir 14'. As this liquid is discharged through the spout 36' power is generated by the electrical generator system 46'. During this operation, the pump 58"is refilling the reservoir 14" such that upon completion of the emptying portion of the cycle of the system 14', the reservoir 14" commences to discharge water through its spout 36", thus, the emptying and refilling cycles are sequenced for generating a constant source of electrical power through the system 46'.

It will, of course, be recognized that the means (shown in connection with FIG. 1) for moving the weights to the positions for refilling the reservoir as described above in connection with the system shown in FIG. 1 will be provided.

While a preferred embodiment has been shown and described, it will be understood that there is no intent to limit the invention by such disclosure, but rather it is intended to cover all modifications and alternate constructions falling within the spirit and scope of the invention as defined in the appended claims and the equivalents thereof.

I claim:

1. A system for rotating a drive mechanism which can be connected to an electrical generator or the like, said system comprising:

a reservoir means for containing a volume of liquid such as water;

weight means for applying a downward pressure to said liquid in said reservoir means;

weight moving means for moving said weight means proximate an upper portion of said reservoir means whereby said weight means applies a downward pressure to an upper surface of said liquid in said reservoir means;

spout means for discharging liquid exiting said reservoir means, said spout means serving to direct and concentrate discharged water into a stream such that said stream of water can be directed against such drive mechanism for imparting rotational forces thereon;

catch basin means for receiving water discharged through said spout means from said reservoir means, said catch basin means being positioned below said spout means; and means for moving said water from said catch basin means into said reservoir means.

2. The system of claim 1 including a frame for supporting said reservoir means above said catch basin means such that water discharged from said spout means is received within said catch basin means.

3. The system of claim 1 wherein said reservoir means comprises a plurality of reservoirs, each of said reservoirs having operatively associated weight means and weight marking means for applying a downward pressure to said liquid in said reservoir, and spout means for discharging water from said reservoir whereby said reservoirs can be sequentially drained and refilled for continuously rotating a drive mechanism.

4. The system of claim 1 wherein said weight means incorporates weights which can be adjusted for varying the downward pressure applied to said liquid contained in said reservoir means.

5. The system of claim 1 wherein said spout means can be selectively opened and closed thereby controlling the discharge of water from said spout means.

6. The system of claim 1 wherein said means for moving said water from said catch basin means to said reservoir means comprises pump means.

7. The system of claim 1 wherein said drive mechanism is connected with an electrical generator whereby rotation of said drive means imparts rotational motion to said electrical generator for the generation of electricity.

8. The system of claim 1 including locking means for locking said weight means into position proximate a top portion of said reservoir.

9. A system for rotating a drive mechanism which can be connected to an electrical generator or the like, said system comprising:

reservoir means for containing a volume of liquid such as water;

weight means for applying a downward pressure to said liquid in said reservoir means, said weight means incorporating weights which can be adjusted for varying the downward pressure applied to said liquid contained in said reservoir means;

spout means for discharging liquid exiting said reservoir means, said spout means serving to direct and concentrate discharged water into a stream such that said stream of water can be directed against such drive mechanism for imparting rotational forces thereon;

catch basin means for receiving water discharged through said spout means from said reservoir means, said catch basin means being positioned below said spout means;

a frame for supporting said reservoir means above said catch basin means such that water discharged from said spout means is received within said catch basin means;

means for moving said water from said catch basin means into said reservoir means; and means for moving said weight means proximate an upper portion of said reservoir means such that said weight means applies a downward pressure to an upper surface of said liquid as said reservoir is being emptied whereby said drive mechanism is connected with an electrical generator and rotation of said drive means imparts rotational motion to said electrical generator for the generation of electricity.

10. The system of claim 9 wherein said reservoir means comprises a plurality of reservoirs, each of said reservoirs having operatively associated weight means for applying a downward pressure to said liquid in said reservoir, and spout means for discharging water from said reservoir whereby said reservoirs can be sequentially drained and refilled for continuously rotating a drive mechanism.

11. The system of claim 10 wherein said spout means can be selectively opened and closed thereby controlling the discharge of water from said spout means.

12. The system of claim 10 wherein said means for moving said water from said catch basin means to said reservoir means comprises pump means.

13. The system of claim 10 including locking means for locking said weight means into position proximate a top portion of said reservoir.

* * * * *